US006355605B1

(12) United States Patent
Weller et al.

(10) Patent No.: US 6,355,605 B1
(45) Date of Patent: Mar. 12, 2002

(54) COMPOSITION AND METHOD FOR REMOVING IRON STAIN AND SCALE

(76) Inventors: David L. Weller, 509 El Mar Ct., Suisun City, CA (US) 94585; Charles C. Hager, Jr., 785 Arabian Cir., Vacaville, CA (US) 95687

( * ) Notice: Subject to any disclaimer, the term of this patent is extended or adjusted under 35 U.S.C. 154(b) by 0 days.

(21) Appl. No.: 09/897,558

(22) Filed: Jul. 3, 2001

(51) Int. Cl.[7] ..... C11D 7/08; C11D 7/10

(52) U.S. Cl. ..... 510/247; 510/245; 510/253; 510/254; 510/255; 510/257; 510/259; 510/269; 510/270; 510/363

(58) Field of Search ..... 510/245, 247, 510/253, 254, 255, 257, 259, 269, 270, 363

(56) References Cited

U.S. PATENT DOCUMENTS

| | | | | | |
|---|---|---|---|---|---|
| 3,754,941 A | * | 8/1973 | Burke | ..... | 106/3 |
| 5,607,911 A | | 3/1997 | Levin et al. | ..... | 510/253 |
| 6,102,972 A | | 8/2000 | Durrant | ..... | 8/137 |

* cited by examiner

*Primary Examiner*—Charles Boyer
(74) *Attorney, Agent, or Firm*—Donald Diamond

(57) ABSTRACT

A cleaning composition and method are provided for removing iron stains and scale from the external surfaces of duck decoys. An illustrative composition contains hydrochloric acid, stannous chloride, ammonium bifluoride, and water. The compositions are applied to the duck decoys with a pressurized sprayer to discolor and dislodge the stain and scale and thereafter the decoys are water rinsed with a garden hose or the like to remove the dislodged material.

23 Claims, No Drawings

COMPOSITION AND METHOD FOR REMOVING IRON STAIN AND SCALE

BACKGROUND OF THE INVENTION

1. Field of the Invention

This invention relates to a cleaning composition and method for treating surfaces to remove iron stain and scale and, more particularly, to a cleaning composition and method for removing iron stain and scale from duck decoys having prolonged exposure to the elements of an aqueous environment.

Duck decoys, which are used by duck clubs for attracting ducks, are usually fabricated from plastics, rubber or fiberglass and painted to match color markings of different breeds of duck. The decoys used by the duck clubs are allowed to continuously remain in ponds and marshes having stagnant water, including brackish water, for up to six months or longer and during this time the decoys collect hard water scale and iron deposits on their external surfaces.

Heretofore, duck decoys having accumulated stain and scale on their external surfaces were cleaned by treating the decoys with highly concentrated acid as, for example, 31% hydrochloric acid which treatment was followed by scrubbing to remove the treated surface deposits.

2. Related Art

The prior art discloses aqueous acidic compositions for removing metallic stains and mineral deposits from diverse surfaces.

U.S. Pat. No. 3,754,941 (Burke, 1973) discloses a cleaning composition for removing aluminum pot marks and other metallic stains such as tin, magnesium and iron from porcelain and ceramic surfaces. The composition contains (a) an oxidant identified as mercuric chloride, cupric chloride, stannous chloride, ferric chloride, auric chloride and silver nitrate for oxidizing the metal in the stain, (b) a fluoride solubilizer identified as ammonium, magnesium zinc and sodium fluorosilicates, sodium fluoride and ammonium bifluoride for removing oxidized metal, and (c) a halide promoter identified as sodium, potassium, magnesium and calcium chlorides, bromides and iodides, wherein the composition has a pH of about 0.5 to 5 in an aqueous medium.

U.S. Pat. No. 5,607,911 (Levin, 1997) discloses an acidulated aqueous composition for removing rust and stain from diverse surfaces, including fiberglass surfaces, and which contains hydrochloric acid, phosphoric acid, tetrasodium EDTA, anionic surfactant, perfume oil and dye.

U.S. Pat. No. 6,102,972 (Durrant, 2000) discloses a method for removing rust stains from carpet which comprises (a) applying a solution of ammonium bifluoride or potassium fluoride to the stain, (b) applying an acidifying solution as, for example, hydrochloric acid which functions as a proton donor causing the formation of hydrofluoric acid on the carpet, (c) rubbing out the stain, and (d) neutralizing the acid.

It would, of course, be very advantageous to provide a cleaning composition and method for removing iron stain and scale from the external surfaces of duck decoys which effectively clean the external surfaces without scrubbing and thereby preserve the paint and the markings on the decoys.

SUMMARY OF THE INVENTION

In accordance with one aspect of this invention, there is provided an aqueous cleaning composition for treating surfaces, including duck decoy external surface, for removal of iron stain and scale, which comprises an acid selected from the group consisting of (a) hydrochloric acid in an amount from about 5 to about 25 wt. % and (b) sulfuric acid in an amount from about 5 to about 10 wt. %, an oxidizable stannous salt in an amount from about 0.5 to about 5 wt. % for reducing ferric ions to ferrous ions, a fluoride composition in an amount from about 0.5 to about 5 wt. % for solubilizing scale, and water to 100 wt. %.

In accordance with a second aspect of this invention, there is provided a method for removing iron stain and scale from the external surfaces of duck decoys, without scrubbing, which comprises:

treating said duck decoys with an aqueous cleaning composition containing:

an acid selected from the group consisting of (a) hydrochloric acid in an amount from about 5 to about 25 wt. % and (b) sulfuric acid in an amount from about 5 to about 10 wt. %, an oxidizable stannous salt in an amount from about 0.5 to about 5 wt. % for reducing ferric ions to ferrous ions, a fluoride composition in an amount from about 0.5 to about 5 wt. % for solubilizing scale, and water to 100 wt. %, and promptly rinsing the treated duck decoys with water.

DETAILED DESCRIPTION

The invention described herein is directed to a cleaning composition and method for removing iron stain and scale from plastic, rubber and fiberglass surfaces such as plastic, rubber or fiberglass surfaces of duck decoys having painted markings.

The cleaning compositions which can be used in the practice of this invention comprise an aqueous solution containing a strong acid, an oxidizable stannous salt, a fluoride composition, and optionally, but advantageously, a surfactant.

Strong acids which can be used in the cleaning compositions include hydrochloric acid and sulfuric acid. Hydrochloric acid is generally present in the aqueous compositions in an amount from about 5 to 25 wt. % and, preferably, in an amount from about 12 to about 20 wt. %. The hydrochloric acid solution can be further formulated with an auxiliary acid such as oxalic acid in an amount from about 4 to about 6 wt. % or phosphoric acid in an amount from about 8 to about 15 wt. %. When sulfuric acid is used as the strong acid, it is generally present in the compositions in an amount from about 5 to about 10 wt. %. The sulfuric acid solution can be further formulated with an auxiliary acid such as phosphoric acid in an amount from about 5 to about 10 wt. %. The acid component is so selected as to provide the cleaning compositions with a pH from about 0.0 to about 0.4.

The oxidizable stannous salts which can be used in the cleaning compositions for reducing ferric ions to ferrous ions include, for example, stannous chloride, stannous fluoride, stannous octoate and mixtures thereof in an amount from about 0.5 to about 5 wt. % and, preferably, in an amount from about 1 to about 2 wt. %.

The fluoride compositions which can be used in the practice of this invention to solubilize scale include, for example, potassium fluoride, ammonium bifluoride, and hydrofluoric acid and mixtures thereof in an amount from about 0.4 to about 5 wt. % and, preferably, in an amount from about 1 to about 2 wt. %.

Surfactants which can be advantageously used in the cleaning compositions include those that are compatible with an acid environment and with multi-valent metal ions. Nonionic surfactants are preferred and, include, for example, Barlox 12 lauryl amine oxide, a nonionic surfactant from Lonza, Inc., Igepal CO-630 polyoxyethylene 9 nonylphenol ether, a nonionic surfactant from Rhone-Poulenc, Inc., Zonyl fluorinated nonionic surfactant from Du Pont and mixtures thereof. Barlox 12 or Igepal CO-630 or a mixture thereof is present in the cleaning compositions in an amount from about 0.1 to about 0.5 wt. %. Zonyl fluorinated surfactant is present in the cleaning composition in an amount from about 0.005 to about 0.2 wt. %.

The compositions are advantageously prepared in a plastic vessel by sequentially adding, with admixing, the following ingredients: water, acid, fluoride composition, oxidizable stannous salt and, optionally, surfactants in accordance with the proportions hereinabove set forth.

Plastic, rubber and fiberglass duck decoys having accumulated iron stain and scale on their external surfaces are readily cleaned, without scrubbing, by treating the external surfaces with the compositions of this invention by spraying with a suitable dispenser or by tub dip and thereafter rinsing the external surfaces with water as, for example, from a pressurized source to wash away the iron compounds and scale that have been dislodged from the external surfaces.

In accordance with this invention, it has been determined that the removal of iron stain from plastic, rubber and fiberglass surfaces can be achieved by a cleaning process that incorporates an acid solution of stannous ions. The stannous ions in acid solutions will electrochemically transfer electrons to the ferric oxide present in iron stains and thereby reduce the colored ferric ions to the colorless ferrous ions, while the stannous ions are oxidized to stannic ions. Ferric ions form tenacious covalent bonds with plastic surfaces. Stannous ions have a covalent affinity for plastics and an electrochemical reaction with the ferric ions, reducing the iron's positive charge and releasing its bond to the plastic surface. Thus, stannous ions in the aqueous acidic compositions of this invention attach to plastic, glass or metal surfaces covalently and ionicly to coat them allowing microscopically close proximity to the iron stain which permits electron transfer to the ferric ions thereby reducing, discoloring and releasing the iron from the treated surfaces.

Microscopic analysis of duck decoy surfaces treated with an acid solution containing stannous ions showed that a minor amount of iron oxide stain remained embedded in paint in pockets that appeared to be protected from attack by stannous ions because of coatings of sulfate or silicate scale. Scrapping or scrubbing these pockets removed the iron oxides and the paint as well, but did not damage the plastic. Thus, the remaining iron stain was a surface phenomenon which was protected by a layer of scale impervious to acid. The addition of fluoride salts such as potassium fluoride, stannous fluoride or ammonium bifluoride to an aqueous acidic solution will produce hydrofluoric acid that will attack and dissolve the sulfate or silica scale thereby permitting the stannous ions to reduce, discolor and dislodge the ferric ions from the duck decoys. The addition of hydrofluoric acid to the stannous ion modified acidic solution will achieve the same result.

Surfactants, when added to the cleaning composition, allow penetration of some of the more protected outer surfaces of the duck decoys. Surfactants enhance the wetting action of water so as to facilitate the treatment and removal of iron stain and scale from the external surfaces of duck decoys without scrubbing. Testing of the acidulated aqueous cleaning composition containing fluoride composition, stannous salt and surfactant demonstrated the efficacy of the composition. Spraying duck decoys having an accumulation of iron stain and scale with this composition, followed by water rinsing, achieved complete removal of iron stain and scale without scrubbing. Microscopic evaluation of the treated duck decoys revealed that no iron stain or scale remained on the surface of the decoys.

The following examples illustrate the development of the invention:

EXAMPLE 1

| Composition | Wt. % |
|---|---|
| Stannous chloride | 2 |
| Hydrochloric acid | 25 |
| Water | 73 |
| | 100 |

A solution in accordance with the above formulation was sprayed, using a trigger sprayer, on iron stained duck decoys, followed by a water rinse with a garden hose. The iron stains disappeared in about 20 seconds without agitation or scrubbing. The decoys used in the test had white necks and tan or green beaks and tails with black bottoms. The white portion of the decoy was transformed to a shiny white, but there was not complete iron removal. Microscopic analysis showed pocketed areas where the iron had not been removed or reduced to colorless ferrous iron. Closer inspection (100× power) revealed a clear to white coating of a silica or sulfate mineral covering the iron stained areas.

EXAMPLE 2

| Composition | Wt. % |
|---|---|
| Stannous chloride | 1 |
| Hydrochloric acid | 10 |
| Water | 89 |
| | 100 |

A solution in accordance with the above formulation was sprayed, using a trigger sprayer, on one-half of an iron stained duck decoy, followed by a water rinse with a garden hose. The solution removed surface stains in about 2 to 3 minutes. Slowly the iron stains decolorized and the decoy's neck and breast areas turned white. Microscopic analysis showed that iron still remained below this white or clear layer.

EXAMPLE 3

| Composition | Wt. % |
|---|---|
| Stannous chloride | 1 |
| Hydrochloric acid | 10 |

-continued

| Composition | Wt. % |
|---|---|
| Ammonium bifluoride | 2 |
| Water | 87 |
| | 100 |

A solution in accordance with the above formulation was sprayed, using a trigger sprayer, on one-half of an iron stained duck decoy, followed by a water rinse with a garden hose. The solution removed the surface and sub-surface iron stains and the white scale in about 2 to about 3 minutes.

EXAMPLE 4

| Composition | Wt. % |
|---|---|
| Stannous chloride | 2.0 |
| Hydrochloric acid | 20.0 |
| Ammonium bifluoride | 1.0 |
| Zonyl fluorinated surfactant | 0.1 |
| Water | 76.9 |
| | 100.0 |

A solution in accordance with the above formulation was sprayed, using a trigger sprayer, on one-half of an iron stained duck decoy and on several previously treated decoys which had some residual iron. In each instance, the iron stain and scale was dissolved and decolorized in less that 20 seconds and the paint on the decoys appeared bright and shiny. This brightening did not fade for days. However, if the solution was left on the surface of the decoys and the decoys were not rinsed, some of the iron color returned.

EXAMPLE 5

| Composition | Wt. % |
|---|---|
| Stannous chloride | 1.20 |
| Hydrochloric acid | 20.00 |
| Ammonium bifluoride | 0.75 |
| Barlox 12 | 0.10 |
| Water | 82.95 |
| | 100.00 |

A solution in accordance with the above formulation was sprayed, using a trigger sprayer, on one-half of an iron stained duck decoy, followed by rinsing. The iron stains and scale on the treated surface dissolved in about 20 to about 30 seconds with minimal scrubbing. There was no damage to the paint.

EXAMPLE 6

| Composition | Wt. % |
|---|---|
| Hydrochloric acid | 15.0 |
| Ammonium bifluoride | 1.5 |

-continued

| Composition | Wt. % |
|---|---|
| Barlox 12 | 0.2 |
| Water | 83.3 |
| | 100.0 |

A solution in accordance with the above formulation was sprayed, using a trigger sprayer, on one-half of an iron stained duck decoy, followed by rinsing, to determine the efficacy of an aqueous acidic solution of ammonium bifluoride, but no stannous ions, in the removal of iron stains. The iron stains got brighter following treatment, but did not change or disappear. The scale dissolved, but the paint remained dull. There was no further change after 10 minutes of contact time. Without the stannous ions, the plastic did not release whatever was dulling the surface and did not release the iron stains.

The following formulations illustrate ingredients and concentration ranges which can be used in the practice of this invention.

EXAMPLE 7

| Ingredients | Wt. %, Range |
|---|---|
| Stannous chloride | 1–2 |
| Hydrochloric acid | 12–25 |
| Ammonium bifluoride | 0.5–1.0 |
| Barlox 12 | 0.1–0.5 |
| Water | 71.5–86.4 |

EXAMPLE 8

| Ingredients | Wt. %, Range |
|---|---|
| Stannous fluoride | 0.5–5 |
| Hydrochloric acid | 10–20 |
| Water | 89.5–75 |

EXAMPLE 9

| Ingredients | Wt. %, Range |
|---|---|
| Stannous fluoride | 0.4–3.5 |
| Hydrochloric acid | 10–20 |
| Surfactant | 0–2 |
| Water | 89.6–74.5 |

EXAMPLE 10

| Ingredients | Wt. %, Range |
|---|---|
| Stannous chloride | 0.4–3.5 |
| Hydrochloric acid | 10–20 |
| Potassium fluoride | 89.6–76.5 |

-continued

| Ingredients | Wt. %, Range |
|---|---|
| Zonyl fluorinated surfactant | 0.0005–0.2 |
| Water | 88.995–72.8 |

EXAMPLE 11

| Ingredients | Wt. %, Range |
|---|---|
| Stannous octoate | 0.5–2.0 |
| Propylene glycol | 2–5 |
| Hydrochloric acid | 10–20 |
| Potassium fluoride | 89.6–76.5 |
| Igepal CO-630 | 0.2–1.0 |
| Water | 87.3–72. |

EXAMPLE 12

| Ingredients | Wt. %, Range |
|---|---|
| Stannous chloride | 0.5–5.0 |
| Oxalic acid | 5 |
| Hydrochloric acid | 10 |
| Ammonium bifluoride | 2–5 |
| Barlox 12 | 0.1–0.5 |
| Water | 82.4–74.5 |

EXAMPLE 13

| Ingredients | Wt. %, Range |
|---|---|
| Stannous fluoride | 0.5–3.5 |
| Hydrofluoric acid | 0.5–2 |
| Hydrochloric acid | 10–20 |
| Surfactant | 0.1–0.5 |
| Water | 88.9–74 |

EXAMPLE 14

| Ingredients | Wt. %, Range |
|---|---|
| Stannous chloride | 0.5–5 |
| Phosphoric acid | 8–15 |
| Hydrochloric acid | 5–20 |
| Ammonium bifluoride | 0.5–2 |
| Surfactant | 0.1–1 |
| Water | 85.9–57 |

EXAMPLE 15

| Ingredients | Wt. %, Range |
|---|---|
| Stannous fluoride | 0.5–3.5 |
| Sulfuric acid | 5–10 |
| Phosphoric acid | 5–10 |

-continued

| Ingredients | Wt. %, Range |
|---|---|
| Ammonium bifluoride | 0.5–5 |
| Surfactant | 0.1–0.5 |
| Water | 88.9–71 |

EXAMPLE 16

| Ingredients | Wt. %, Range |
|---|---|
| Stannous chloride | 0.5–3.5 |
| Hydrofluoric acid | 5–10 |
| Sulfuric acid | 5–10 |
| Surfactant | 0.1–3 |
| Water | 93.4–77 |

EXAMPLE 17

| Ingredients | Wt. %, Range |
|---|---|
| Stannous fluoride | 0.4–2 |
| Ammonium bifluoride | 3–5 |
| Surfactant | 0.1–1 |
| Water | 96.5–92 |

EXAMPLE 18

| Composition | Wt. % |
|---|---|
| Stannous chloride | 1.5 |
| Ammonium bifluoride | 3.0 |
| Barlox 12 | 0.2 |
| Water | 95.3 |
| | 100.0 |

A solution in accordance with the above formulation was sprayed, using a pump sprayer, on iron stained duck decoys, followed by a water rinse with a garden hose. The pH of the above formulation was about 3. The iron stains and scale were readily removed and the duck decoys appeared bright and shiny.

EXAMPLE 19

| Composition | Wt. % |
|---|---|
| Hydrochloric acid | 15.0 |
| Stannous fluoride | 1.5 |
| Igepal CO-630 | 0.2 |
| Water | 83.3 |
| | 100.0 |

A solution in accordance with the above formulation was sprayed, using a pump sprayer, on iron stained duck decoys, followed by a water rinse with a garden hose. The iron stains were readily removed from the lightly stained areas in about 30 seconds, but took a little longer for stain removal in the heavily stained areas. This example illustrates that stannous fluoride can provide both the stannous ions and the fluoride components of the formulation.

In view of the foregoing description and examples and the claims hereinafter set forth, it will become apparent to those of ordinary skill in the art that equivalent modifications thereof may be made without departing from the spirit and scope of this invention.

That which is claimed is:

1. An aqueous cleaning composition for treating surfaces to remove iron stain and scale which consists essentially of:

an acid selected from the group consisting of (a) hydrochloric acid in an amount from about 5 to about 25 wt. % and (b) sulfuric acid in an amount from about 5 to about 10 wt. %, an oxidizable stannous salt in an amount from about 0.5 to about 5 wt. % for reducing ferric ions to ferrous ions, a fluoride compound selected from the groupconsisting of potassium fluoride, ammonium bifluoride, and hydrofluoric acid in an amount from about 0.5 to about 5 wt. % for solubilizing scale, and water to 100 wt. %.

2. The composition of claim 1 wherein the acid is hydrochloric acid and the composition further includes an auxiliary acid selected from the group consisting of (a) oxalic acid in an amount from about 4 to about 6 wt. % and (b) phosphoric acid in an amount from about 8 to about 15 wt. %.

3. The composition of claim 1 wherein the acid is hydrochloric acid in an amount from about 12 to about 20 wt. %.

4. The composition of claim 1 wherein the acid is sulfuric acid and the composition further includes phosphoric acid in an amount from about 5 to about 10 wt. %.

5. The composition of claim 1 wherein the stannous salt is a member selected from the group consisting of stannous chloride, stannous fluoride, stannous octoate and mixtures thereof in an amount from about 1 to about 2 wt. %.

6. The composition of claim 1 wherein the fluoride compound is present in an amount from about 0.5 to about 2 wt %.

7. The cleaning composition of claim 1 which further includes an acid compatible surfactant.

8. A cleaning composition for treating duck decoys to remove iron stain and scale which consists essentially of:

an acid selected from the group consisting of (a) hydrochloric acid in an amount from about 5 to about 25 wt. % and (b) sulfuric acid in an amount from about 5 to about 10 wt. %, an oxidizable stannous salt in an amount from about 0.5 to about 5 wt. % for reducing ferric ions to ferrous ions, a fluoride in compound selected from the group consisting of potassium fluoride, ammonium bifluoride, and hydrofluoric acid in an amount from about 0.5 to about 5 wt. % for solubilizing scale, and water to 100 wt. %.

9. The composition of claim 8 wherein the acid is hydrochloric acid and the composition further includes an auxiliary acid selected from the group consisting of (a) oxalic acid in an amount from about 4 to about 6 wt. % and (b) phosphoric acid in an amount from about 8 to about 15 wt. %.

10. The composition of claim 8 wherein the acid is hydrochloric acid in an amount from about 12 to about 20 wt. %.

11. The composition of claim 8 wherein the acid is sulfuric acid and the composition further includes phosphoric acid in an amount from about 5 to about 10 wt. %.

12. The composition of claim 8 wherein the stannous salt is a member selected from the group consisting of stannous chloride, stannous fluoride, stannous octoate and mixtures thereof in an amount from about 1 to about 2 wt. %.

13. The composition of claim 8 wherein the fluoride compound is present in an amount from about 0.5 to about 2 wt %.

14. The cleaning composition of claim 8 which further includes an acid and multi-valent metal ion compatible surfactant.

15. The composition of claim 8 wherein the acid is hydrochloric acid in an amount from about 12 to about 20 wt. %, the oxidizable stannous salt is stannous chloride in an amount from about 1 to about 2 wt. %, and the fluoride composition is ammonium bifluoride in an amount from about 0.5 to about 2wt. %.

16. A method for removing iron stain and scale from duck decoys which comprises:

treating said duck decoys with an aqueous cleaning composition containing:

an acid selected from the group consisting of (a) hydrochloric acid in an amount from about 5 to about 25 wt. % and (b) sulfuric acid in an amount from about 5 to about 10 wt. %, an oxidizable stannous salt in an amount from about 0.5 to about 5 wt. % for reducing ferric ions to ferrous ions, a fluoride compound selected from the group consisting of potassium fluoride, ammonium bifluoride, and hydrofluoric acid in an amount from about 0.5 to about 5 wt. % for solubilizing scale, and water to 100 wt. %, and promptly washing the treated duck decoys with water.

17. The method of claim 16 wherein the acid is hydrochloric acid and the composition further includes an auxiliary acid selected from the group consisting of (a) oxalic acid in an amount from about 4 to about 6 wt. % and (b) phosphoric acid in an amount from about 8 to about 15 wt. %.

18. The method of claim 16 wherein the acid is hydrochloric acid in an amount from about 12 to about 20 wt. %.

19. The method of claim 16 wherein the acid is sulfuric acid and the composition further includes phosphoric acid in an amount from about 5 to about 10 wt %.

20. The method of claim 16 wherein the stannous salt is a member selected from the group consisting of stannous chloride, stannous fluoride, stannous octoate and mixtures thereof in an amount from about 1 to about 2 wt. %.

21. The method of claim 16 wherein the fluoride compound is present in an amount from about 0.5 to about 2 wt %.

22. The method of claim 16 wherein the cleaning composition further includes an acid and multi-valent metal ion compatible surfactant.

23. The method of claim 16 wherein the acid is hydrochloric acid in an amount from about 12 to about 20 wt. %, the oxidizable stannous salt is stannous chloride in an amount from about 1 to about 2 wt. %, and the fluoride composition is ammonium bifluoride in an amount from about 0.5 to about 2 wt. %.

* * * * *